United States Patent [19]

Huang

[11] Patent Number: 5,020,558

[45] Date of Patent: Jun. 4, 1991

[54] AUTOMATIC UMBRELLA HAVING STABLE EXTENDING AND FOLDING STRUCTURE

[76] Inventor: Sheng-Fu Huang, P.O. Box 55-1670, Taipei (10477), Taiwan

[21] Appl. No.: 605,666

[22] Filed: Oct. 29, 1990

[51] Int. Cl.[5] ..... A45B 25/14

[52] U.S. Cl. ..... 135/24; 135/28; 135/33.4

[58] Field of Search ..... 135/22–24, 135/28, 38–41, 48, 36 R, 25 R

[56] References Cited

U.S. PATENT DOCUMENTS

| | | | |
|---|---|---|---|
| 2,165,967 | 7/1939 | Haupt | 135/40 X |
| 3,658,076 | 4/1972 | Yasuda | 135/22 |
| 3,856,030 | 12/1974 | Sato | 135/22 |
| 4,624,275 | 11/1986 | Baldwin | 135/25 R X |
| 4,682,617 | 7/1987 | Schultes et al. | 135/22 X |
| 4,766,917 | 8/1988 | Yang | 135/25 R |

FOREIGN PATENT DOCUMENTS

| | | | |
|---|---|---|---|
| 1076892 | 5/1953 | France | 135/24 |

*Primary Examiner*—Richard E. Chilcot, Jr.
*Assistant Examiner*—Lan Mai

[57] ABSTRACT

An automatic umbrella includes a telescopic shaft having a lower outer tube telescopically mounted with an upper inner tube, a locking device pivotally formed in a grip and a lower portion of the central shaft having a single hook portion respectively engageable with two hook holes formed in a lower runner pivotally secured with a plurality of stretcher ribs of a rib assembly of the umbrella for locking a folded umbrella by engaging a lower hook hole in the lower runner with the hook portion of the locking device and for shielding the rib tips into the grip by engaging the hook portion with an upper hook hole of the lower runner, thereby stably locking the folded umbrella.

6 Claims, 7 Drawing Sheets

AUTOMATIC UMBRELLA HAVING STABLE EXTENDING AND FOLDING STRUCTURE

BACKGROUND OF THE INVENTION

A conventional automatic umbrella as shown in FIG. 1 includes: a plurality of ribs R pivotally secured to a lower runner L, a middle runner M and an upper runner U respectively, a central telescopic shaft including a lower slim tube S1 and an upper outer tube S2 having a diameter larger than that of the lower tube S1, and a grip G formed on a lower portion of the shaft having two spring catches C1, C2 for locking a folded umbrella and for shielding the tips T of the plurality of ribs R into the grip G when lowering the lower runner L.

Since the upper tube S2 is larger in diameter than the lower tube S1 and a central hole O inside the lower runner L is larger than an outside diameter of the upper tube S2, it will form a large aperture between the tube S1 and the runner L so that the lower runner L will not be stably engaged with either catch C1 or C2 and will be easily released from the catch C1, C2 to cause an unexpected opening of a folded umbrella.

The present inventor has found the drawbacks of a conventional automatic umbrella, and invented the present automatic umbrella having stable extending and folding structure.

SUMMARY OF THE INVENTION

The object of the present invention is to provide an automatic umbrella including a central telescopic shaft having a lower outer tube telescopically mounted with an upper inner tube, a locking device pivotally formed in a grip and a lower portion of the central shaft having a single hook portion respectively engageable with two hook holes formed in a lower runner pivotally secured with a plurality of stretcher ribs of a rib assembly of the umbrella for locking a folded umbrella by engaging a lower hook hole in the lower runner with the hook portion of the locking device and for shielding the rib tips within the grip by engaging the hook portion with an upper hook hole of the lower runner, thereby stably locking the folded umbrella.

DETAILED DESCRIPTION

Figures 2, 2A:
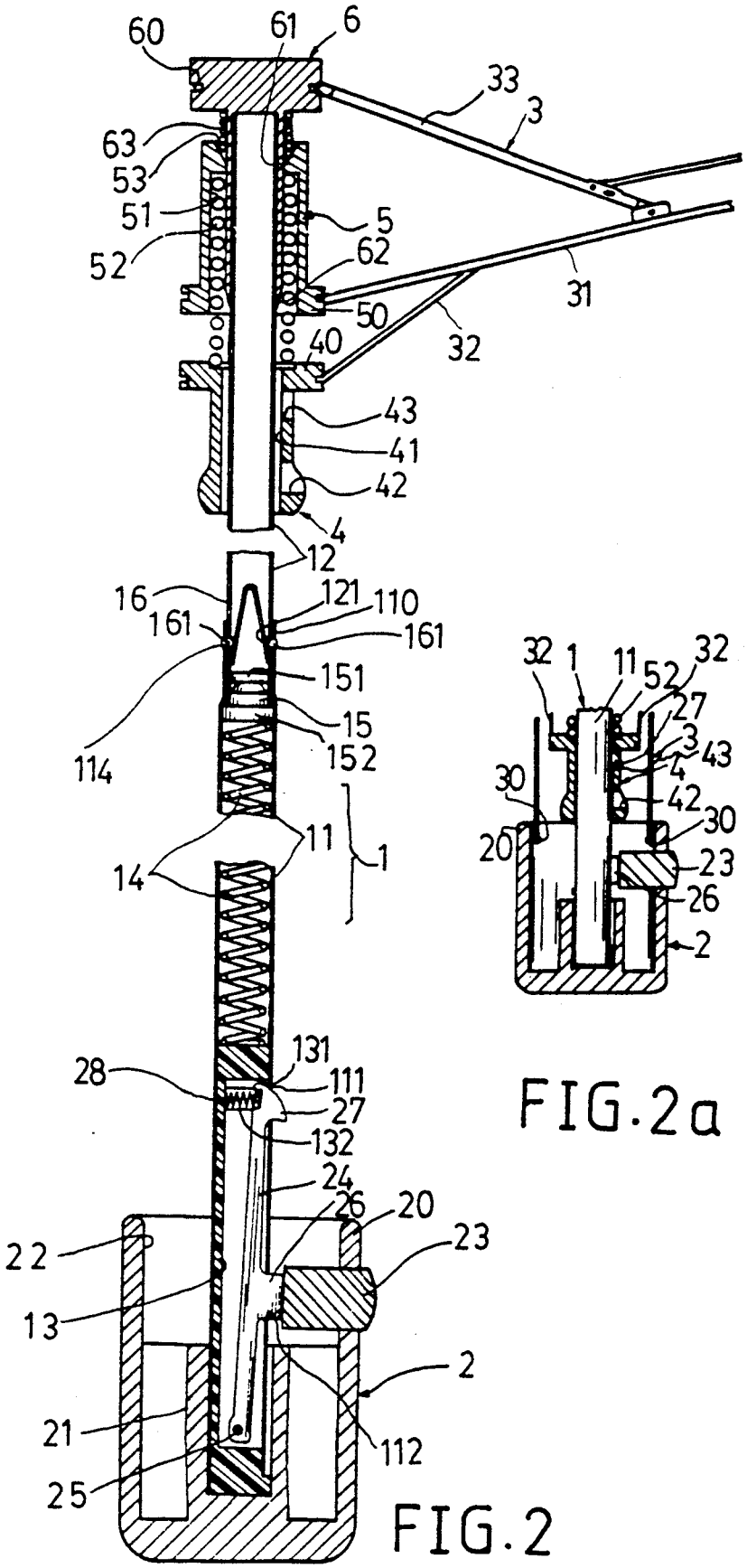
FIG. 2 shows an extended umbrella of the present invention.
FIG. 2*a* shows a folded umbrella by shielding the rib tips in a grip of the present invention.
Figure 3:
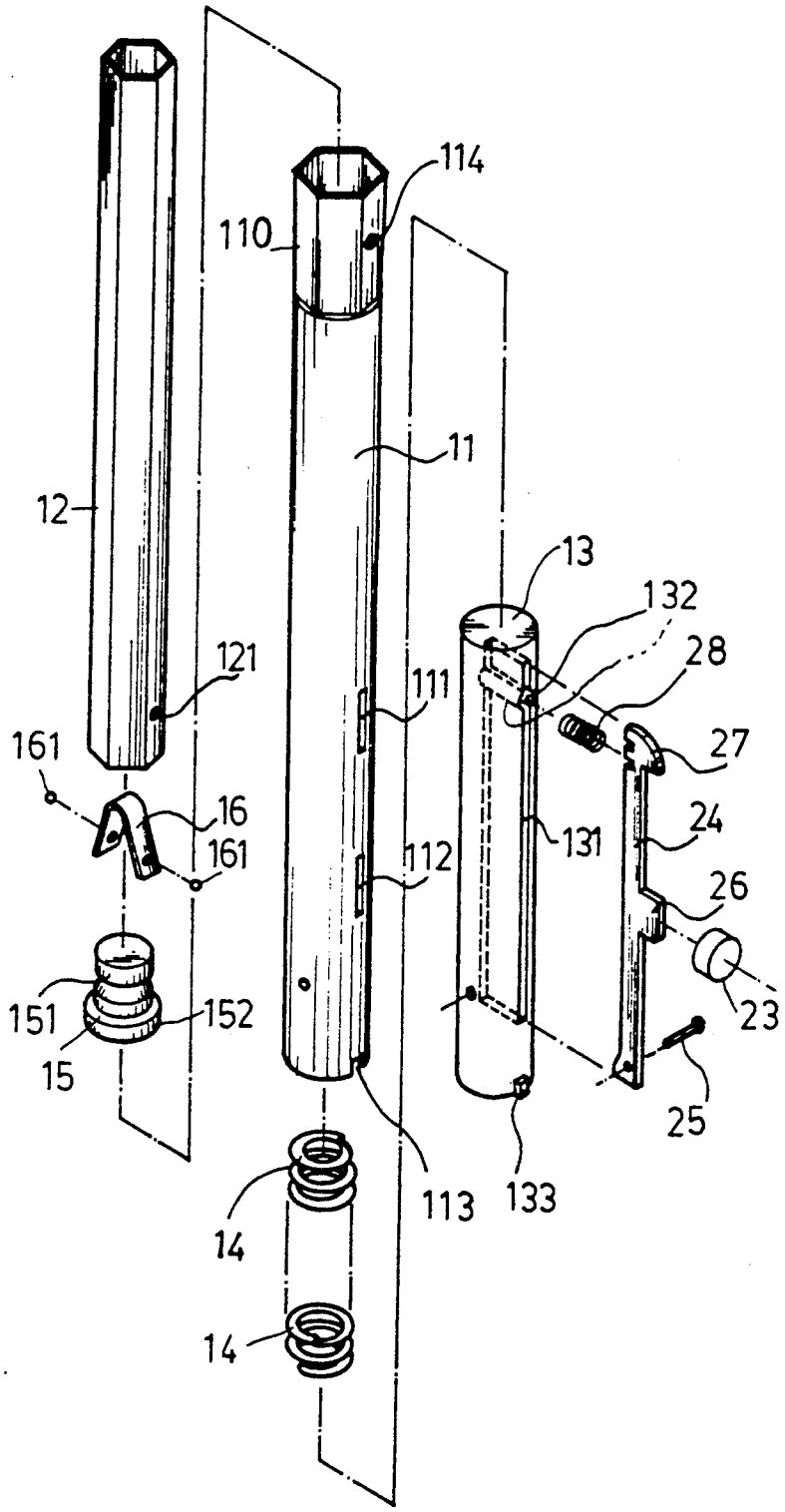
FIG. 3 is an exploded view showing the central shaft of the present invention.
Figure 4:
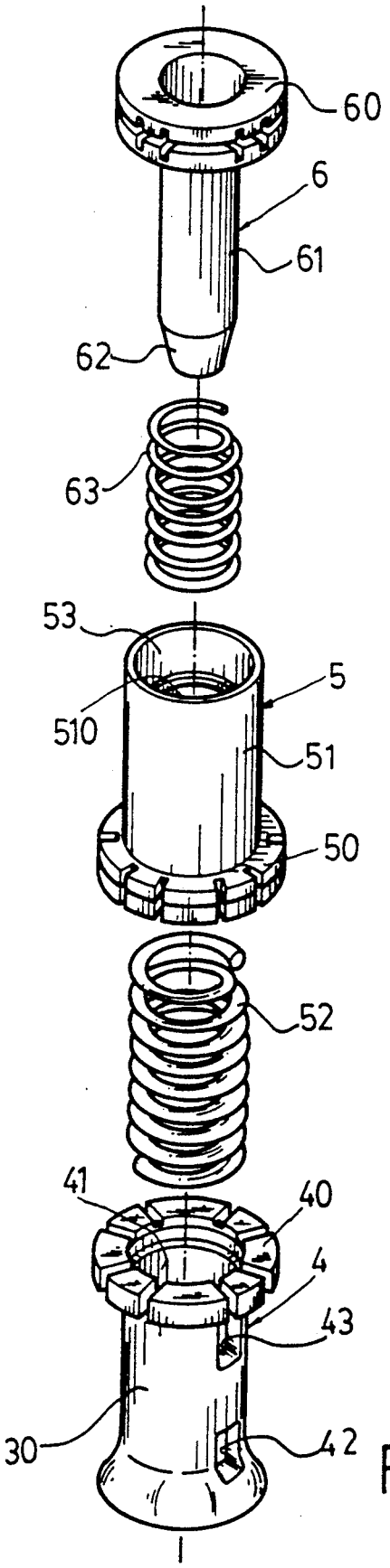
FIG. 4 shows the runners of the present invention.

As shown in FIGS. 2–4, the present invention comprises: a telescopic shaft means 1, a grip 2, a rib assembly means 3, a lower runner 4, a middle runner 5, and an upper notch 6.

The telescopic shaft means 1 includes: a lower outer tube 11, an upper inner tube 12 telescopically mounted in the lower tube 11, a lower sleeve 13 inserted in a lower portion of the lower tube 11, a shaft-restoring spring 14 extendibly retained between the lower sleeve 13 and a plug 15 fixed on a bottom portion of the upper tube 12, and a coupling spring 16 resiliently coupling the two tubes 11, 12 for extending the shaft means 1.

The plug 15 includes an upper plug portion 151 fixed in a bottom portion of the upper tube 12, and a lower flange 152 secured under the upper plug portion 151 having a diameter larger than that of the upper plug portion 151 slidably held in the lower tube 11.

An upper portion 110 of the lower tube 11 may be formed as a contraction portion or hexagonal portion of its cross section contracted from the tube 11 to limit an upward movement of the plug 15 when extending the shaft means 1. The upper tube 12 may also be formed as a hexagonal shape of its cross section. The shape of the tubes 11, 12 is not limited in this invention.

The coupling spring 16 may be formed as a V shape as shown in FIG. 2 having its two spring ends resiliently urging two balls 161 each engageable with two ball holes 121, 114 respectively formed in the upper tube 12 and the lower tube 11 for resiliently coupling the two tubes 11, 12 when extending the shaft means 1.

The lower sleeve 13 is generally formed as a cylindrical core body as shown in FIG. 3 inserted in a lower portion of the lower tube 11 having a longitudinal slot 131 longitudinally formed in the sleeve 13 and a protrusion 133 formed on a bottom portion of the sleeve 13 engageably embedded with a protrusion slot 113 formed in a bottom portion of the lower tube 11 for preventing rotation of the sleeve 13 in the tube 11.

The grip 2 includes: a tip cap 20 defining a tip socket 22 therein for shielding the rib tips 30 when folding the umbrella as shown in FIG. 2*a*, a spindle 21 formed on a central portion of the grip 2 for fixing the lower tube 11 therein, a push button 23 protruding laterally outwardly through the grip 2, a lower locking means generally formed as an elongate plate 24 pivotally formed in the lower portion of lower tube 11 by a pivot 25 having a central lug 26 protruding laterally outwardly through the slot 131 in the sleeve 13 and a lug slot 112 formed in the tube 11, and an upper hook portion 27 formed on an upper portion of the locking means 24 protruding outwardly through the slot 131 and a hook slot 111 formed in the tube 11 above the lug slot 112 as resiliently retained by a hook spring 28 held in a spring socket 132 formed in an upper portion of the longitudinal slot 131 of the sleeve 13. The hook portion 27 normally protrudes outwardly beyond the lower tube 11 and will be retracted inwardly when depressing the push button 23. The sleeve 13 may be made by plastic molding process or other methods or materials.

The lower runner 4 includes: an upper flange 40 pivotally secured with a stretcher rib 32 of the rib assembly means 3 for securing umbrella cloth, a central cylindrical hole 41 formed through the runner 4 having a diameter slightly larger than an outside diameter of the lower outer tube 11, a lower hook hole 42 laterally formed through a lower portion of the runner 4, and an upper hook hole 43 laterally formed through an upper portion of the runner 4. Both hook holes 42, 43 are respectively engageable with the upper hook portion 27 of the locking means 24.

The middle runner 5 includes: a lower flange 50 pivotally secured with a main rib 31 of the rib assembly means 3, a runner sleeve 51 generally cylindrical shaped defining a cylindrical hole 510 therein, a rib-restoring spring 52 held in the sleeve 51 and retained between the sleeve 51 and the upper flange 40 of the lower runner 4, and a truncated-cone hole 53 formed in an upper portion of the sleeve 51 and tapered downwardly.

The upper notch 6 includes: an upper flange 60 pivotally secured with a top rib 33 of the rib assembly means 3, an upper sleeve 61 protruding downwardly from the flange 60 on an upper portion of the upper inner tube 12 for operatively engaging the middle runner 5 when extending the umbrella as shown in FIG. 2 for commonly holding the spring 52 with the sleeve 51 of the middle runner 5, a taper portion 62 formed on a bottom periphery of the sleeve 61 for tangentially sliding the sleeve 61 (with taper portion 62) in the truncated-cone hole 53 in the runner 5, and a buffer spring 63 retained under the flange 60 for dampening a quick upward movement of the runner 5 when opening the umbrella.

The rib assembly means 3 may include a plurality of ribs adapted for multiple folds of an automatic umbrella.

When opening the present invention from a folded state, the push button 23 is depressed to disengage the hook hole 42 or 43 of the lower runner 4 from the upper hook portion 27 of the locking means 24, the restoring spring 14 will extend the folded shaft means 1 and the restoring spring 52 will extend the ribs 3 for opening the umbrella. The buffer spring 63 serves for the buffer of the upward movement of the runners 5, 4 when opening the umbrella. When extending the central shaft means 1, the flange 152 of the plug 15 fixed to the upper inner tube 12 will be limited at the contraction portion 110 formed on an upper portion of the lower outer tube 11. The two balls 161 as urged by the coupling spring 16 will resiliently couple the two tubes 12, 11 at holes 121, 114 for stabilizing the extended tubes of the shaft means 1.

During the upward moving of the middle runner 5, the truncated-cone hole 53 of the middle runner 5 will slidably engage the taper portion 62 of the upper sleeve 61 formed under the upper notch 6. The rib-restoring spring 52 is disposed between the upper sleeve 61 and the runner sleeve 51 of the middle runner 5. Therefore, the ribs 3 and the secured umbrella cloth will be stably retained at their extending condition when opening the umbrella.

For folding the umbrella of the present invention, the lower runner 4 is pulled downwardly to retract the ribs 3 and the upper inner tube 12 also retracted into the lower outer tube 11 to engage the lower hook hole 42 of the runner 4 with the hook portion 27 of the locking means 24, thereby locking the folded umbrella stably. Since the cylindrical hole 41 in the runner 4 is slightly larger than the outside diameter of the lower tube 11, the runner 4 of the folded umbrella will not be vibrated, inclined or loosened on the tube 11 so as for ensuring an efficient engagement of the hook portion 27 with the hole 42 in runner for stabilizing the folding operation of the umbrella.

Figure 1:
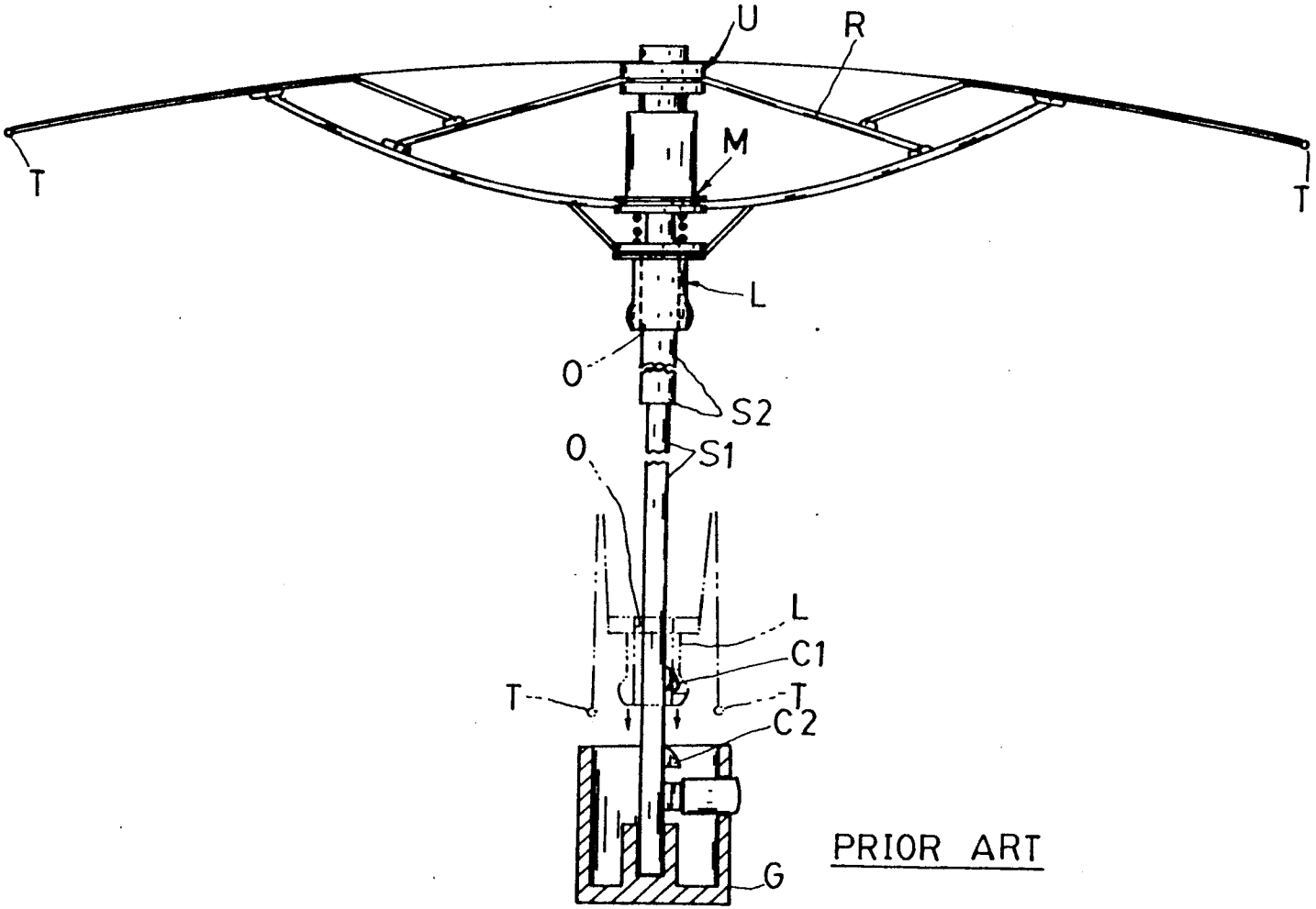
PRIOR ART FIG. 1
FIG. 1 shows a prior art of a conventional foldable automatic umbrella.

By grasping all tips 30 of the umbrella ribs 3 and depressing the grip 2 to allow the upper hook hole 43 in runner 4 to engage the hook portion 27, the tips 30 will then be shielded within the tip cap 20 of the grip 2 for portable convenience. The hook portion 27 is a single hook, rather than the double catches C1, C2 of a conventional umbrella as shown in FIG. 1 of the prior art, to simplify the structure and construction of the present invention to be superior to the conventional umbrella.

This invention provides an automatic umbrella which is very stable at either an opening or a closing state by means of the stable construction as aforementioned.

Figure 5:
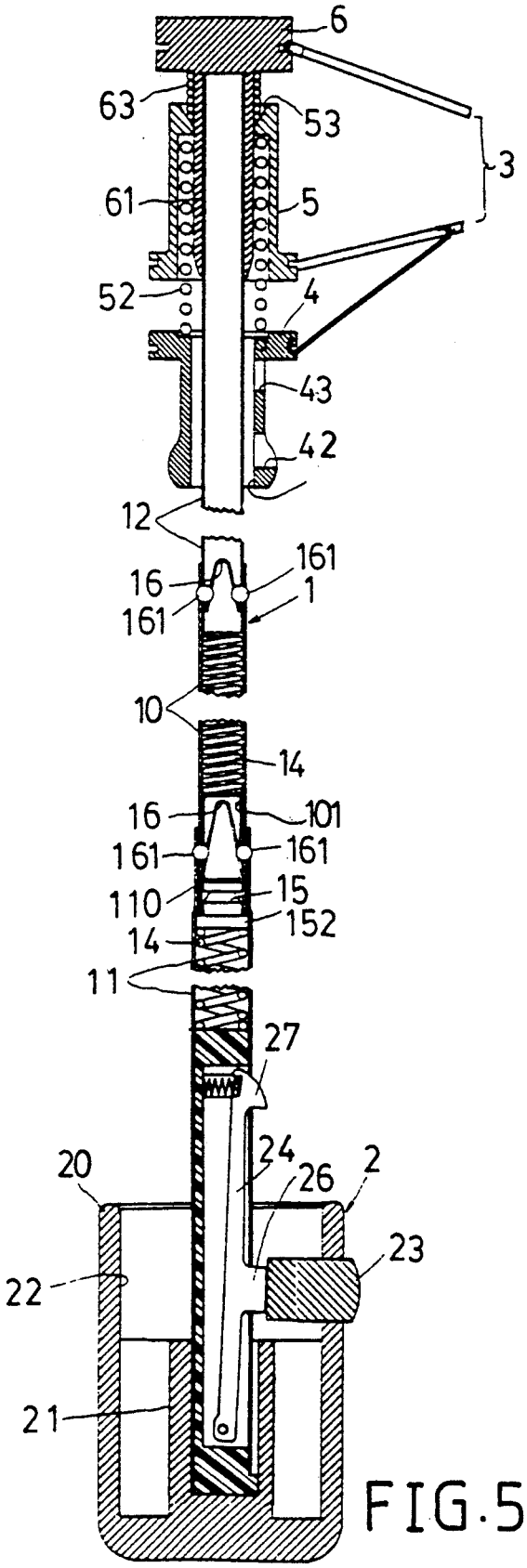
FIG. 5 shows another preferred embodiment of the present invention.
Figure 6:
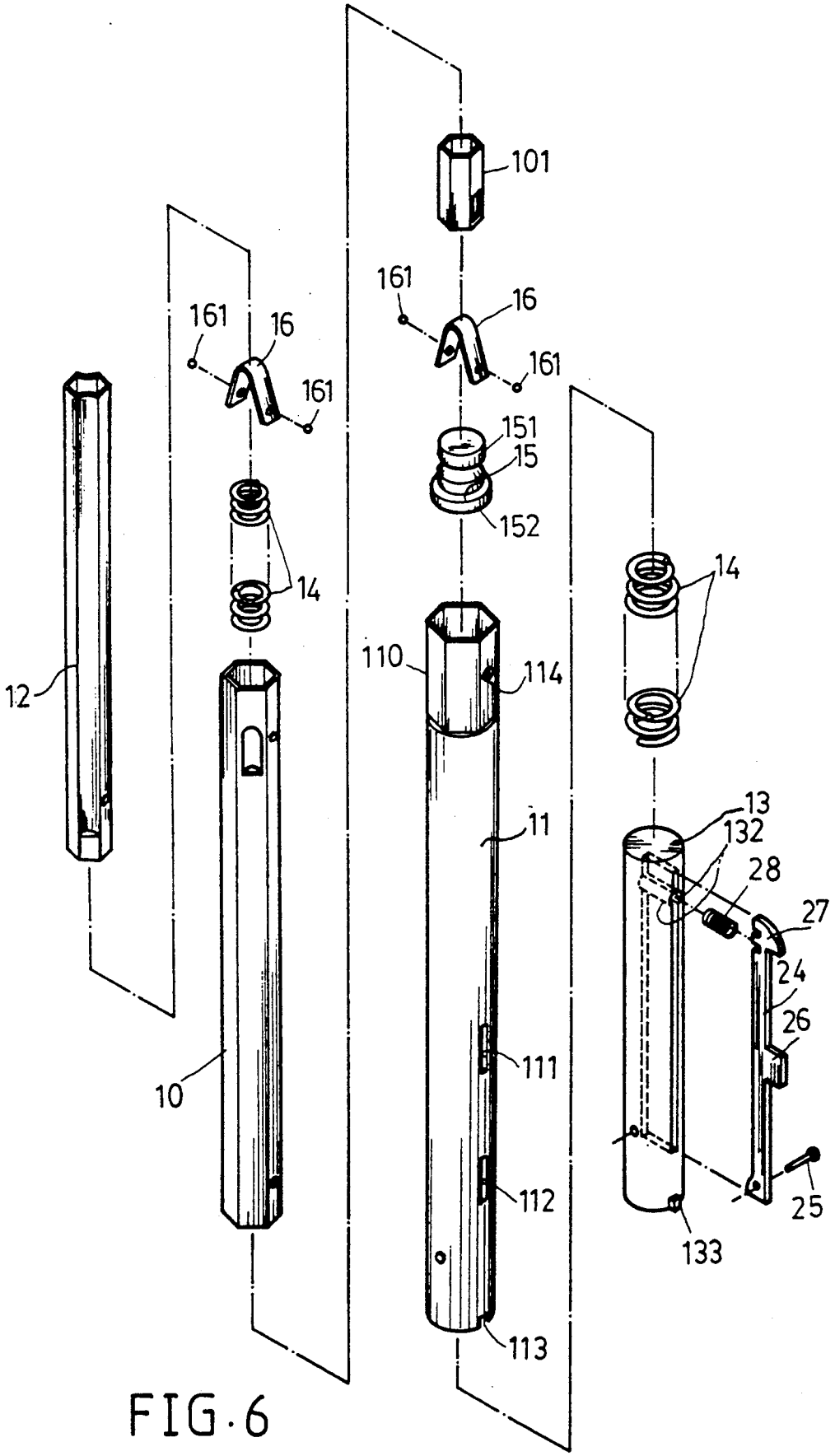
FIG. 6 is a partial exploded view of FIG. 5.

The present invention may be modified to multiple folds such as a triple fold umbrella as shown in FIGS. 5, 6, wherein a middle tube 10 is telescopically mounted between the upper inner tube 12 and the lower outer tube 11. A further restoring spring 14 is inserted in the middle tube 10 to be retained between a lower portion of the upper tube 12 and a lower collar 101 secured in a lower portion of the tube 10. Two coupling springs 16 are provided to respectively couple the upper tube 12 and the lower tube 11. The plug 15 is fixed in a lower portion of the tube 10 to be upwardly limited by the upper portion 110 of the tube 11.

Figure 7:
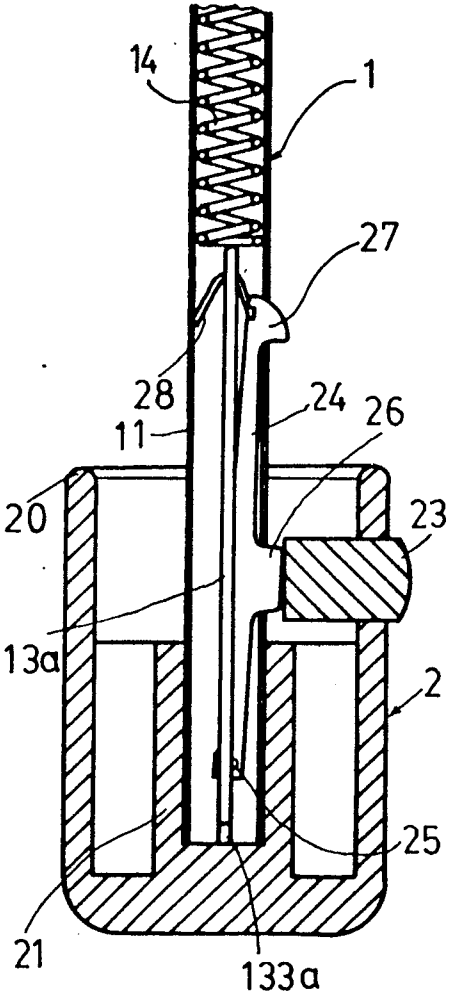
FIG. 7 shows another preferred embodiment of a lower portion of the present invention.
Figure 8:
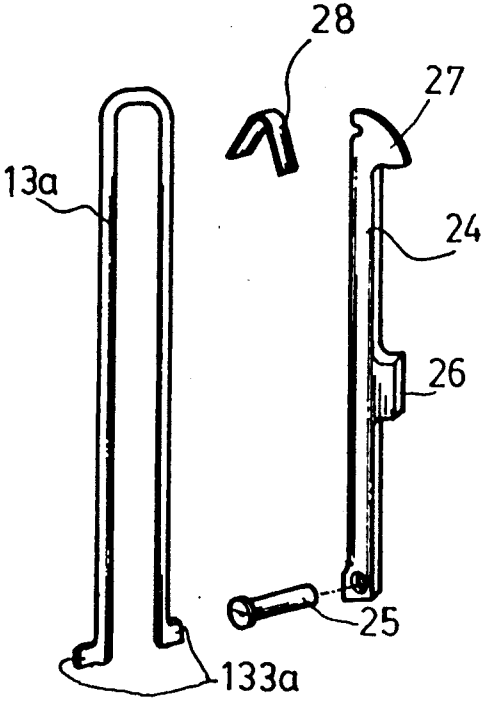
FIG. 8 is a perspective view showing partial elements of the present invention as shown in FIG. 7.

The lower sleeve 13 as shown in FIGS. 3, 6 may be substituted with a U-shaped holder 13*a* as shown in FIGS. 7, 8. The U-shaped holder 13*a* includes two lower protrusions 133*a* to be fixed into two slots 113 formed in the tube 11. The longitudinal plate of the locking means 24 is slidably held in the U-shaped holder 13*a* as shown in FIG. 7 having the upper hook portion 27 urged by a V-shaped spring 28 held in the tube 11. The U-shaped holder 13*a* may simplify the structure of sleeve 13 as shown in FIG. 3. The restoring spring 14 may be directly retained on an upper portion of the U-shaped holder 13*a*.

The present invention may be modified without departing from the spirit and the claiming scope of this invention.

When retracting the shaft means 1 of the present invention, the rib tips 30 may also be lowered to be disposed outside the tip cap 20 of the grip 2 when engaging the upper hole 43 with the hook portion 27.

I claim:

1. An automatic umbrella comprising:

a telescopic shaft means including a lower outer tube, an upper inner tube telescopically mounted in the lower outer tube, a lower sleeve inserted in a lower portion of said lower outer tube, and a shaft-restoring spring held in said shaft means for resiliently extending said upper inner tube beyond said lower outer tube;

a grip fixed on a lower portion of said lower outer tube having a tip cap formed on an upper portion of said grip defining a tip socket therein, a push button protruding laterally from a lower locking means pivotally formed in said lower sleeve through the grip, and an upper hook portion formed on an upper portion of said locking means resiliently urged by a hook spring formed in said sleeve to be protruded outwardly through said lower sleeve and said lower tube;

a lower runner pivotally secured with a stretcher rib of a rib assembly means secured with an umbrella cloth thereon having a central cylindrical hole formed through said lower runner having a diameter slightly larger than an outside diameter of said lower outer tube, and at least a hook hole formed in said lower runner operatively engageable with said hook portion of said lower locking means;

a middle runner pivotally secured with a main rib of said rib assembly means having a truncated-cone hole formed in an upper portion of a runner sleeve retaining a rib-restoring spring in said runner sleeve and on said lower runner for resiliently extending said rib assembly means; and an upper notch pivotally secured with a top rib of said rib assembly means having an upper sleeve protruding downwardly from said upper notch to be slidably engageable with said truncated-cone hole in said middle runner for stabilizing said upper notch and said middle runners when opening the automatic umbrella.

2. An automatic umbrella according to claim 1, wherein said lower runner includes a lower hook hole and an upper hook hole laterally formed through said lower runner respectively engageable with said upper hook portion of said locking means in said grip.

3. An automatic umbrella according to claim 1, wherein said lower sleeve is generally formed as a cylindrical core body inserted in a lower portion of said lower tube having a longitudinal slot formed in said lower sleeve for slidably pivotally securing said locking means generally formed as an elongate plate in said longitudinal slot.

4. An automatic umbrella according to claim 1, wherein said upper sleeve of said upper notch is formed with a taper portion on its lower portion to be slidably engageable with said truncated-cone hole in said middle runner.

5. An automatic umbrella according to claim 1, wherein said shaft means further includes a middle tube telescopically mounted between said upper inner tube and said lower outer tube.

6. An automatic umbrella according to claim 1, wherein said lower sleeve is a U-shaped holder fixed in said lower tube for slidably holding said locking means in said U-shaped holder.

* * * * *